United States Patent [19]

Smith

[11] 4,241,656

[45] Dec. 30, 1980

[54] SELF-CLEANING NOZZLE FOR LITHOGRAPHIC PRINTING DAMPENERS

[75] Inventor: Gary R. Smith, Bucyrus, Kans.

[73] Assignee: Smith R. P. M. Corporation, Overland Park, Kans.

[21] Appl. No.: 961,532

[22] Filed: Nov. 17, 1978

[51] Int. Cl.[3] ..... B41F 7/30; B41L 25/06

[52] U.S. Cl. ..... 101/148; 101/366; 239/434.5

[58] Field of Search ..... 101/147, 148, 366; 239/398, 416.5, 418, 423, 424, 424.5, 426, 432, 433, 434, 434.5

[56] References Cited

U.S. PATENT DOCUMENTS

| | | | |
|---|---|---|---|
| 391,865 | 10/1888 | Schutte | 239/400 |
| 1,339,579 | 5/1920 | Runyan | 239/406 |
| 1,987,248 | 1/1935 | Seizer | 239/434.5 X |
| 2,069,346 | 2/1937 | Wilka | 239/434.5 |
| 2,405,375 | 8/1946 | Smith | 261/116 |
| 3,310,240 | 3/1967 | Grundman | 239/404 |
| 3,463,601 | 8/1969 | Childree | 431/158 |
| 3,622,080 | 11/1971 | Greenwood | 239/426 |
| 3,717,306 | 2/1973 | Hushon et al. | 239/404 |
| 3,774,843 | 11/1973 | Rice | 239/14 |
| 3,908,903 | 9/1975 | Burns | 239/14 X |
| 3,949,668 | 4/1976 | Smith, Jr. | 101/148 |
| 3,972,690 | 8/1976 | VanOs | 239/405 X |
| 4,128,206 | 12/1978 | Bintner | 239/11 |

*Primary Examiner*—J. Reed Fisher

*Attorney, Agent, or Firm*—Fishburn, Gold & Litman

[57] ABSTRACT

A self-cleaning nozzle for lithographic printing dampeners includes a central liquid duct and an air expansion chamber surrounding the liquid duct and defined by a cylindrical wall closed at an entrance end by a baffle having circumferential slits therethrough and at an exit end by a planar end wall spaced from the termination of the liquid duct and forming a mixing corridor therebetween. The end wall is positioned perpendicular to the liquid duct and to the direction of air traveling through the expansion chamber, thereby increasing turbulence in the air to more effectively break up the liquid stream into fine droplets. A slot orifice is formed in the end wall and is defined by a peripheral surface which forms an acute angle with an inner surface of the end wall and an obtuse angle with the outer surface thereof.

2 Claims, 9 Drawing Figures

SELF-CLEANING NOZZLE FOR LITHOGRAPHIC PRINTING DAMPENERS

The present invention relates to mixing nozzles and more particularly to a self-cleaning nozzle for producing dampening spray in lithographic printing systems.

BACKGROUND OF THE INVENTION

Moisture is required in lithographic printing to produce proper ink separation on the printing plate. Sufficient, but not excessive, dampening at the printing plate allows ink transfer from ink rollers where desired, and prevents ink from adhering to those portions which are free of printing areas. The use of spray heads for this purpose has met with varying success. An example of a relatively successful spray dampening system is disclosed in U.S. Pat. No. 3,949,688, issued Apr. 13, 1976, wherein individual positive displacement metering pumps are employed for supplying moisture to respective nozzles in a bank of adjacent nozzles for directing moisture toward the printing plate. This system has been found to accurately vary the moisture output of each nozzle while variation of a master drive controls overall bank output.

Although much sophistication has been achieved in supplying dampening liquid to spray nozzles, problems have remained in the basic function of the nozzle itself. Gum arabic and glycerin are common additives to water in lithographic dampening. Both materials have a tendency to dry or otherwise produce sticky deposits adjacent the discharge orifice of conventional nozzles, causing clogging and/or a distortion of the spray pattern and/or particle size desired for the printing process. Also, such additive deposits on the nozzle exterior secure lint, dust, and other foreign material common to a printing environment, causing further spray distortion.

The present invention overcomes the above difficulties in a lithographic spray dampening nozzle through the use of a modified structure which provides internal mixing of the dampening liquid with turbulent, expanding air and subsequent high velocity exit of the mixture through a single orifice having an abrupt, angular flare toward the outside.

The principal objects of the present invention are: to provide an improved self-cleaning nozzle for spraying dampening liquid in lithographic printing systems; to provide such a nozzle which effects mixing of a stream of dampening liquid with turbulent, expanding air within the nozzle; to provide such a nozzle including a wall positioned for substantially perpendicular impingement by high velocity air to effect high turbulence therein; to provide such a nozzle including an exit orifice forming surface which forms an acute angle and an obtuse angle respectively with the inner and outer surfaces of the wall in which the orifice is formed; to provide such a nozzle wherein the exit orifice may be elongated to shape the spray pattern; to provide such a nozzle which is compatible with many existing lithographic dampening systems; to provide such a nozzle which may be conveniently formed of molded synthetic resins; and to provide such a nozzle which is economical to manufacture, reliable and durable in operation, and which is particularly well adapted for its intended purpose.

Other objects and advantages of this invention will become apparent from the following description taken in connection with the accompanying drawings wherein are set forth, by way of illustration and example, certain embodiments of this invention.

The drawings constitute a part of the specification, include an exemplary embodiment of the present invention, and illustrate various objects and features of the self-cleaning nozzle.

Figure 1:
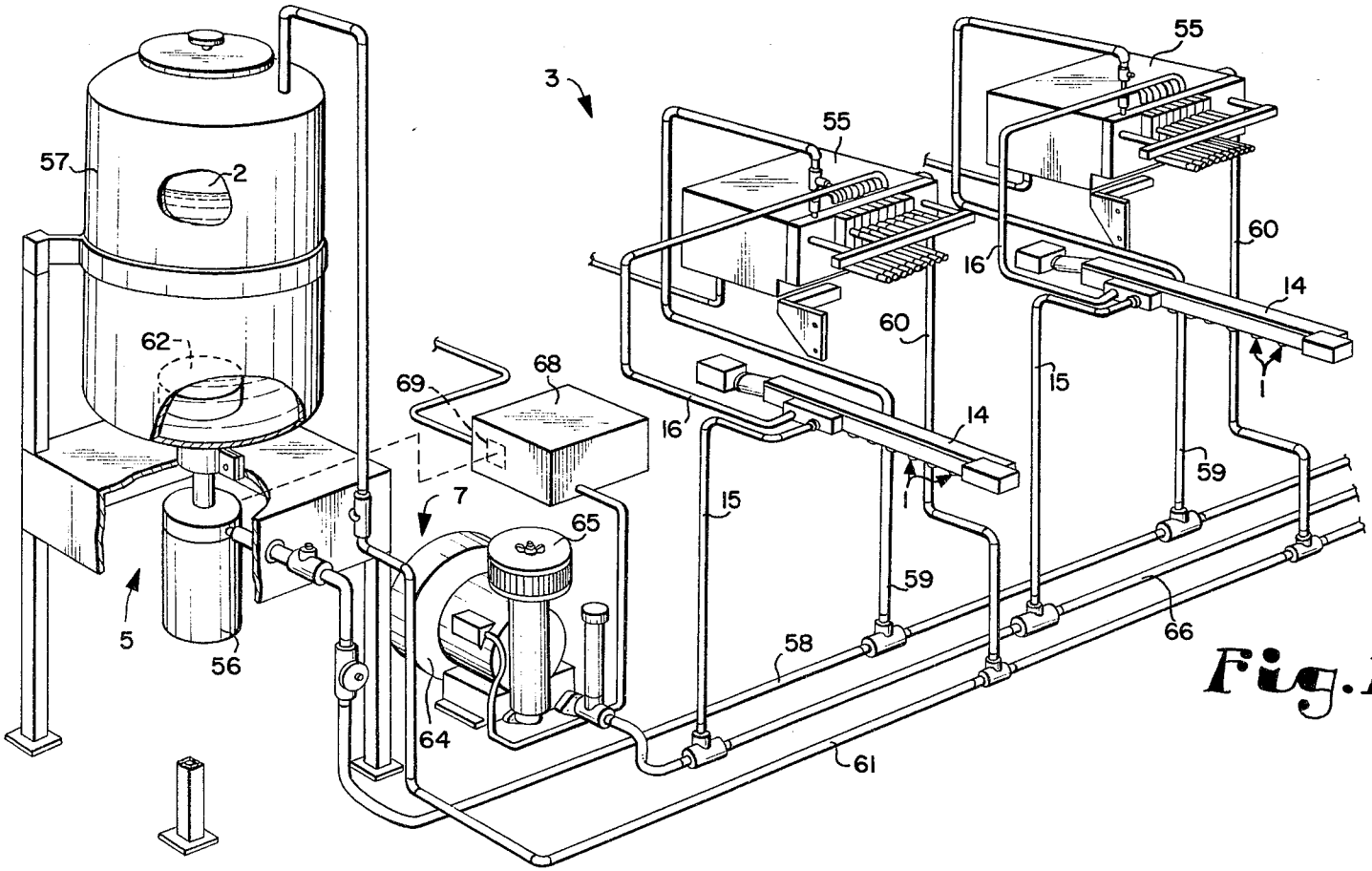
FIG. 1 is a partially schematic perspective view showing a spray dampening system embodying the spray nozzle therein.

Referring to the drawings in more detail:

The reference numeral 1 generally designates a self-cleaning nozzle for use in forming a fine spray of dampening liquid 2 in a lithographic dampening system 3. The nozzle 1 generally includes a liquid duct 4 communicating with a liquid source 5 and an air expansion chamber 6 communicating with an air source 7. The nozzle 1 includes an end wall 8 spaced from an end or termination 9 of the liquid duct 4 and forming a mixture area or corridor 10 therebetween. The end wall 8 is positioned for substantially perpendicular impingement by air flowing through the expansion chamber 6 before entering the mixing corridor 10 to thereby effect turbulence in the air. The wall 8 is provided with an orifice 11 for the high velocity exit of the dampening liquid 2 in a fine spray having a controlled spray pattern.

Figure 4:
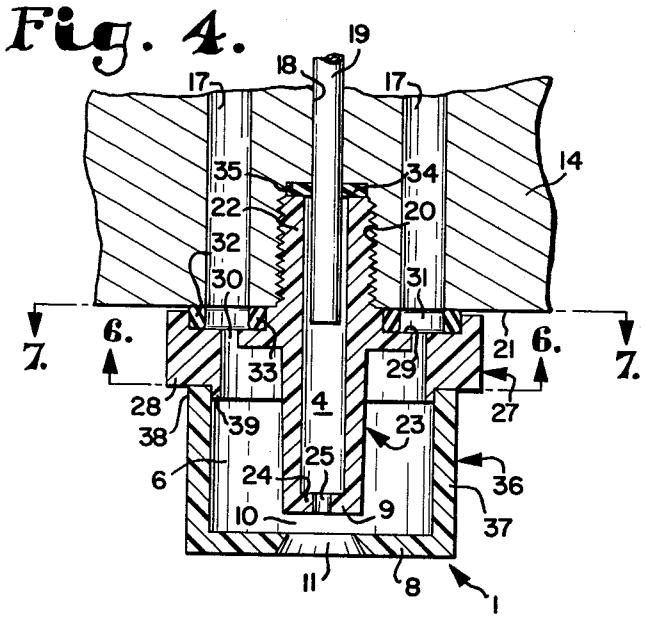
FIG. 4 is an enlarged longitudinal sectional view of the nozzle.
Figure 7:
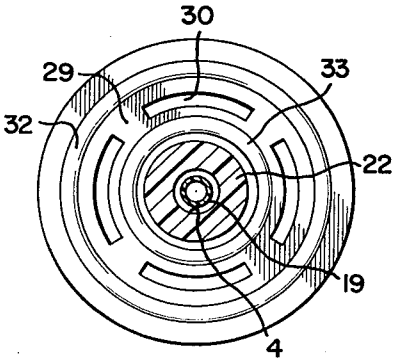
FIG. 7 is a transverse sectional view along line 7—7 in FIG. 4.

As illustrated in FIG. 1, a plurality of the nozzles 1 are positioned on a spray bar 14 to which are connected an air conduit 15 and at least one, although preferably a plurality, of liquid transmitting conduits or lines 16. Referring to FIG. 4, the spray bar 14 includes air supply bores 17 and a liquid supply bore 18 formed therein and communicating respectively with the air conduit 15 and the liquid conduit 16. The liquid bore 18 may include an extension 19 of the liquid conduit 16 therein for communicating directly with the liquid duct 4 of the nozzle 1. Preferably, the liquid bore 18 includes a threaded counterbore 20 formed adjacent an external surface 21 of the spray bar 14 to receive an externally threaded projection 22 of the nozzle 1 therein. The threaded projection 22 is tubular, forming a part of the liquid duct 4, and provides a means for removably attaching the nozzle 1 to the spray bar 14.

Within the expansion chamber 6, the liquid duct 4 is defined by a tubular member 23 which may be integral with the projection 22. The termination 9 of the liquid duct 4, and therefore of the tubular member 23, is preferably an inwardly projecting flange 24 defining a sub-orifice 25 having a diameter less than the diameter of the liquid duct 4. The flange 24 forms a constriction of the liquid duct 4 to thereby increase the velocity of liquid issuing therefrom.

The nozzle 1 includes a baffle 27 for the distribution of air from the supply bores 17 to the expansion chamber 6. The baffle 27 includes an annular outer portion 28 connected to the tubular member 23 and the threaded projection 22 by means of a spider 29. The spider 29 is provided with arcuate or circumferential slits 30 to provide for air flow from the air bores 17 into the air expansion chamber 6. The baffle 27 includes a circumferential channel 31 recessed into the side of the baffle 27 facing the external surface 21 of the spray bar 14. The channel 31 provides communication and air distribution from the air bores 17 to the slits 30, and, further, receives an O-ring 32 therein to provide a gas seal between the nozzle 1 and the spray bar 14. The channel 31 may include a second O-ring 33 spaced inwardly of the O-ring 32 and a liquid seal washer 34 may be included in the counterbore 20 for sealing between the end surface 35 of the counterbore 20 and the end of the projection 22. Preferably, the baffle 27, the threaded projection 22, and the tubular member 23 form an integral member.

The main portion of the air expansion chamber 6 is defined by a housing member 36 including a cylindrical sidewall 37 and the end wall 8. The housing 36 may be attached to the annular outer portion 28 of the baffle 27 by reception of the open end 38 of the cylindrical wall 37 on a projecting rim 39 of the baffle 27 and bonded thereto, as by gluing.

Figure 5:
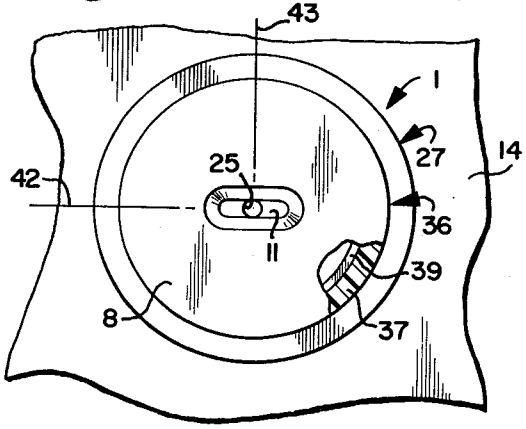
FIG. 5 is an enlarged bottom plan view of the nozzle.
Figure 8:
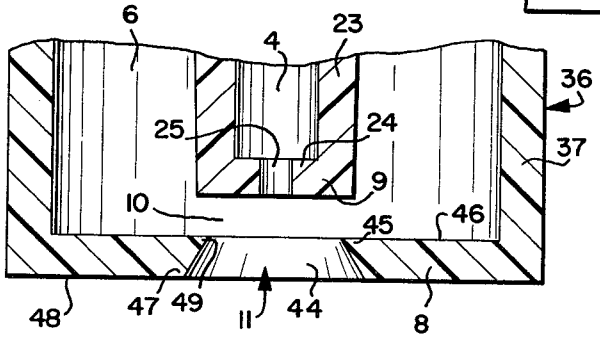
FIG. 8 is a greatly enlarged fragmentary sectional view similar to FIG. 4 and illustrating details of the exit end of the nozzle.

With reference to FIG. 5, the orifice 11 is preferably a rounded slot having a greater dimension along a long axis 42 than in the direction of a short axis 43 thereof. The orifice 11 may be oval or elliptical in shape. In cross section, as shown in FIG. 8, the orifice 11 is defined by a quasi-conical peripheral orifice surface 44 forming an acute angle 45 with an inner surface 46 of the end wall 8 and an obtuse angle 47 with an outer surface 48 of the wall 8. The orifice 11, therefore, includes a sharp inner rim or knife-like corner 49 adjacent the mixing corridor 10 and flares to the outside.

In operation, compressed air supplied through the air bores 17 enters the circumferential chamber 31 for distribution through the slits 30 in the baffle 27 to the air expansion chamber 6 where, because of the relatively large cross sectional area thereof, the velocity of the air is decreased, resulting in an increase in the pressure of the air traveling through the chamber 6. However, the increased pressure within the chamber results in an increase in the velocity of the air as it exits the orifice 11. Because of the perpendicular orientation of the end wall 8, the direction of the air flow is abruptly changed thereby, such that the air entering the mixing corridor 10 is in a highly turbulent state before exiting through the orifice 11. Without a flow of air from the expansion chamber 6, the liquid 2 would issue from the sub-orifice 25 in a substantially solid stream. However, with the presence of the turbulent expanding air in the mixing corridor 10, the solid stream of liquid is broken up into droplets. As the droplets of liquid and turbulent air exit through the orifice 11, collisions with the acute inner rim 49 coupled with abrupt direction changes and pressure drop of the air cause a substantial breakup of the droplets, resulting in a fine atomization thereof.

Figure 9:
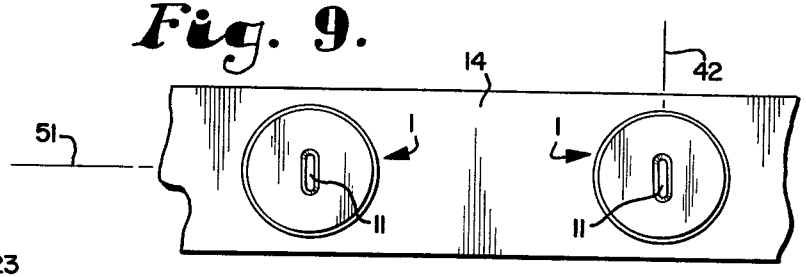
FIG. 9 is a bottom plan view at a reduced scale illustrating the preferred orientation of the slot orifices of a plurality of the nozzles.

FIG. 9 illustrates the preferred orientation of the long axes 42 of the orifices 11 of the nozzles 1 in relation to the longitudinal axis 51 of spray bar 14. As shown, the nozzles 1 are spaced along the spray bar 14, and the long axis 42 of each orifice 11 is substantially perpendicular to the longitudinal axis 51 of the spray bar 14. The spray pattern of the liquid 2 issuing from the orifice 11 is an elongated pattern which has a long axis (not shown) which is oriented substantially perpendicular to the long axis 42 of the orifice 11. The nozzles 1 are spaced apart in such a manner that the spray patterns overlap to desired degree in order to effectively cover a dampening roller 52 (see FIG. 2) in a lithographic printing press 53.

The nozzle 1 constructed according to the present invention is substantially self-cleaning such that the buildup of residues of additives in the dampening liquid 2 about the orifice 11, which would tend to distort the spray pattern therefrom, is avoided. The continuous flow of air at high velocity through the mixing corridor 10 propels substantially all of the liquid 2 issuing from the suborifice 25 from the mixing corridor 10 whereby the buildup of residues within the nozzle is prevented. The flow of liquid and air through the orifice itself is at a high enough velocity that little, if any, liquid is able to cling thereto. During operation, the flow of air through the nozzle 1 is begun before the liquid 2 is pumped therethrough. When shutting down operation of the dampening system, the liquid flow is terminated before the flow of air is, whereby any liquid clinging about the orifice 11 is driven therefrom by the flow of high velocity air therethrough. The only places where deposits are likely to occur are on the outer periphery of the outer surface 48 of the end wall 8. Such deposits may be removed with relative ease because of the simple shape of the outer surface 48.

Referring to FIG. 1, the liquid supply system 5 includes a metering pump 55 for each spray bar 14. The metering pump 55 is operative to supply a measured volume of the dampening liquid 2 per unit time to the nozzles 1. The liquid system 5 includes a liquid pressure pump 56 receiving the liquid 2 from a reservoir 57 and is operative to supply the liquid under constant pressure to the metering pumps 55. The liquid system 5 may be a closed system including a main liquid supply conduit 58 with liquid supply conduits 59 branching therefrom to respective metering pumps 55. Branch liquid return conduits 60 are joined to a main liquid return conduit 61 which returns unused liquid to the reservoir 57 for recycling. Preferably, the liquid supply system includes a filter 62 to preclude foreign matter such as lint and the like from the liquid system to prevent clogging of the lines and nozzle 1.

The air supply system 7 includes a compressor 64, including an air filter 65. The compressed air is supplied by means of a main air supply line 66 having the air supply conduits 15 branching therefrom and connecting with the air bores 17 in the spray bars 14. The dampening system 3 includes a control circuit 68 which preferably includes a timing circuit 69 operative to coordinate the liquid system 5 and the air system 7 such that the flow of air is always begun before the flow of the dampening liquid 2 and such that the flow of air is continued for a selected duration after the flow of liquid is terminated.

Figure 2:
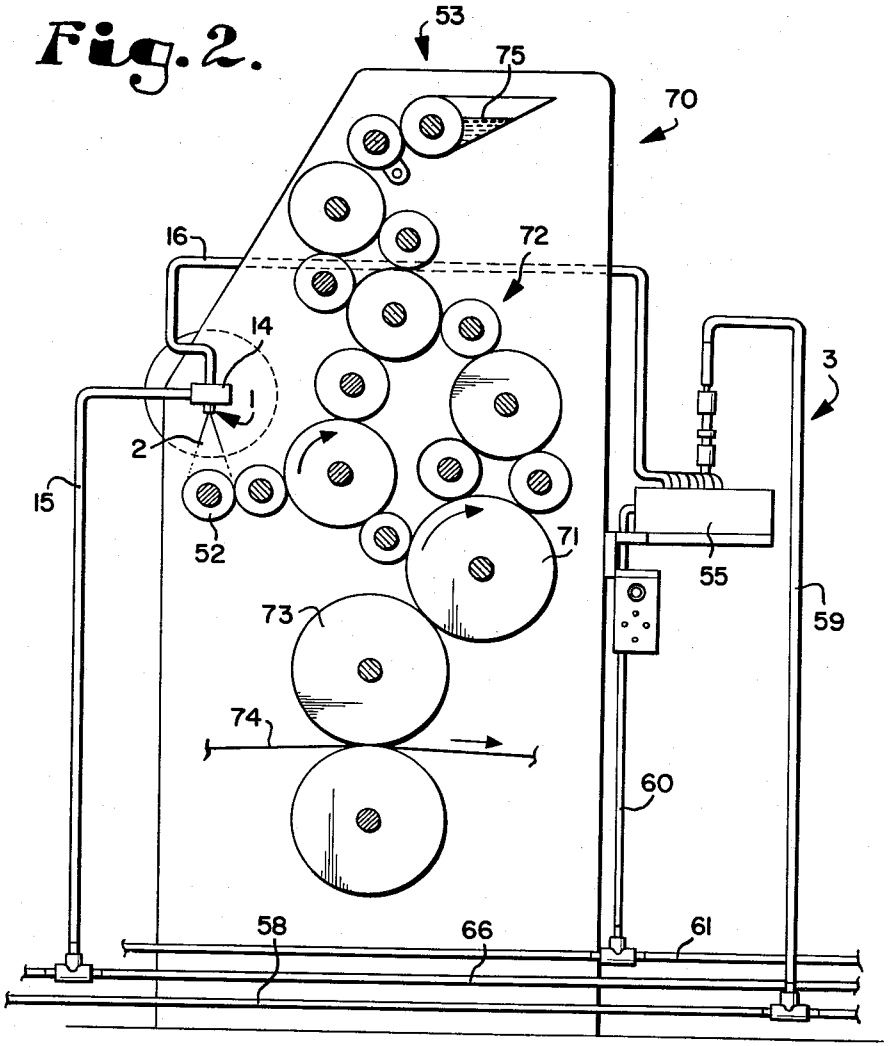
FIG. 2 is a fragmentary, partially schematic side elevation showing the spray nozzle in conjunction with a lithographic printing system.
Figure 6:
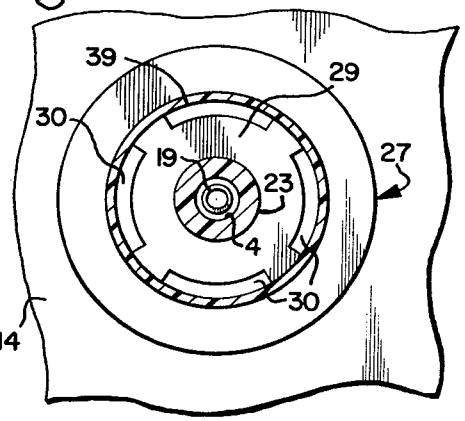
FIG. 6 is a transverse sectional view along line 6—6 in FIG. 4.

FIG. 2 illustrates a single tower 70 of a conventional lithographic printing press 53 having the nozzle 1 installed therein to supply dampening liquid therefor. The tower 70 includes a plate cylinder 71 having a lithographic printing plate (not shown) installed thereon to receive ink from an ink train or group of rollers 72 on certain areas thereof for transfer to a blanket cylinder 73 and eventual deposit on a printing web or sheet 74. As illustrated, the spray bar 14 is oriented to position the nozzle 1 for directing a spray pattern of the dampening liquid 2 directly to a dampening roller 52. The roller 52 is engaged with the ink train rollers 72 such that the dampening liquid 2 is intermixed with the ink 75 for application to the plate cylinder 71 to prevent the ink 75 from being applied to non-printing areas of the printing plate.

Figure 3:
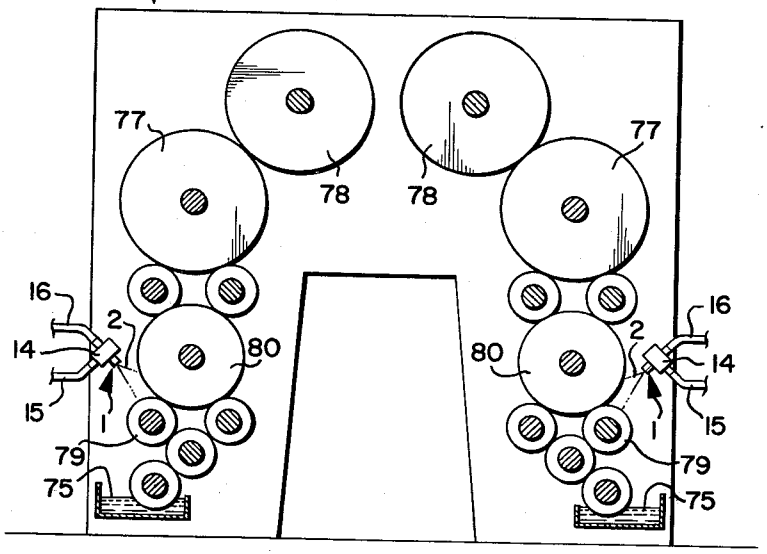
FIG. 3 is a fragmentary, partially schematic side elevational view showing the spray nozzle in conjunction with a direct lithographic printing system.

FIG. 3 illustrates a direct lithographic or di-litho printing system 76 which is similar in many respects to a conventional lithographic system except that no blanket cylinder is employed therein. In the di-litho system 77, ink is transferred directly from a printing plate (not shown) positioned on the plate cylinder 77 to a printing web or sheet (not shown) engaged between the plate cylinder 77 and an impression cylinder 78. As shown in the di-litho system 76, the spray bar 14 may be oriented so as to direct the dampening spray between a set of dampening rollers 79 and 80 in order to facilitate the intermixing of the dampening liquid 2 with the printing ink 75.

While certain forms of the present invention have been described and illustrated, it is not to be limited thereto except insofar as such limitations are included in the following claims.

What I claim and desire to secure by Letters Patent is:

1. A self-cleaning nozzle for use in forming a fine spray of dampening liquid in a lithographic printing system, said system including respective sources of air and of liquid, both at greater than atmospheric pressure, said nozzle comprising:

(a) means forming an elongated liquid duct, said duct including a termination and communicating with said source of liquid;

(b) means forming an air passage, said passage communicating with said source of air;

(c) a housing defining an air expansion chamber communicating with said air passage;

(d) said housing including an end wall spaced from said termination of said liquid duct and forming a mixing corridor therebetween, said mixing corridor having said air expansion chamber with said liquid duct in communication therewith;

(e) said end wall being positioned for substantially perpendicular impingement by air before entering said mixing corridor to thereby effect turbulence in said air for the breakup into droplets of a stream of said liquid issuing from said duct termination;

(f) an orifice formed in said end wall for the turbulent exit of said droplets and air from said nozzle for further breakup and transport of said droplets into a fine spray;

(g) said housing including a circumferential wall spaced radially from said means forming said liquid duct and defining said air expansion chamber in cooperation therewith, said chamber being bounded at one end by said end wall;

(h) a baffle extending between said means forming said liquid duct and said circumferential wall, said baffle bounding another end of said air expansion chamber; and (i) a plurality of circumferential slits formed in said baffle, said slits extending in surrounding relation to said means forming said liquid duct and providing communication between said source of air and said air expansion chamber.

2. A self-cleaning nozzle for use in forming a fine spray of dampening liquid in a lithographic printing system, said system including respective sources of air and of liquid, both at greater than atmospheric pressure, said nozzle comprising:

(a) means forming a elongated liquid duct, said duct including a termination and communicating with said source of liquid;

(b) means forming an air passage, said passage communicating with said source of air;

(c) a housing defining an air expansion chamber communicating with said air passage;

(d) said housing including an end wall spaced from said termination of said liquid duct and forming a mixing corridor therebetween, said mixing corridor having said air expansion chamber and said liquid duct in communication therewith;

(e) said end wall being positioned for substantially perpendicular impingement by air before entering said mixing corridor to thereby effect turbulence in said air for the breakup into droplets of a stream of said liquid issuing from said duct termination;

(f) an orifice formed in said end wall for the turbulent exit of said droplets and air from said nozzle for further breakup and transport of said droplets into a fine spray;

(g) said printing system including a nozzle support body having tubular bores formed therein and communicating respectively with said sources of air and liquid for communication respectively with said air passage and said liquid duct, the liquid bore including an internally threaded counterbore adjacent an external face of said nozzle support body;

(h) said means forming said liquid duct including an externally threaded tubular projection received in said counterbore for removable attachment of said nozzle to said support body;

(i) said nozzle including a baffle at an end of said air expansion chamber opposite the end having said end wall, said baffle extending between said means forming said liquid duct and said housing;

(j) said baffle including a circumferential channel recessed into a side of said baffle facing the external face of said support body, said channel communicating with the bore associated with said source of air;

(k) a resilient annular seal member received in said channel in sealing engagement between said baffle and said external face of said support body; and (l) a plurality of circumferential slits formed in said baffle inward of said seal member, said slits providing communication between said channel and said air expansion chamber.

* * * * *